US008941437B2

(12) United States Patent
Nakamoto

(10) Patent No.: US 8,941,437 B2
(45) Date of Patent: Jan. 27, 2015

(54) BIAS CIRCUIT

(71) Applicant: Fujitsu Limited, Kawasaki-shi, Kanagawa (JP)

(72) Inventor: Hiroyuki Nakamoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 14/189,780

(22) Filed: Feb. 25, 2014

(65) Prior Publication Data

US 2014/0306751 A1 Oct. 16, 2014

(30) Foreign Application Priority Data

Apr. 11, 2013 (JP) ..... 2013-083262

(51) Int. Cl.
*G05F 1/10* (2006.01)
*G05F 3/02* (2006.01)

(52) U.S. Cl.
USPC ..... 327/543; 327/539

(58) Field of Classification Search
USPC ..... 327/538–541, 543
See application file for complete search history.

(56) References Cited

U.S. PATENT DOCUMENTS

| | | | | |
|---|---|---|---|---|
| 5,949,227 | A * | 9/1999 | Bujanos | 323/313 |
| 6,011,429 | A | 1/2000 | Oda | |
| 6,496,057 | B2 * | 12/2002 | Wada et al. | 327/543 |
| 8,319,547 | B1 * | 11/2012 | Tan et al. | 327/541 |
| 8,350,611 | B1 * | 1/2013 | Hsu | 327/198 |

FOREIGN PATENT DOCUMENTS

JP 10-222234 A 8/1998

* cited by examiner

*Primary Examiner* — Quan Tra
(74) *Attorney, Agent, or Firm* — Arent Fox LLP

(57) ABSTRACT

A bias circuit includes: a reference current generation circuit that has a first reference-current element disposed in a first current path and has a second reference-current element disposed in a second current path; a first current mirror circuit that has a first transistor connected in series with the first reference-current element and has a second transistor connected in series with the second reference-current element; a third reference-current element disposed in a third current path disposed between the power supply terminal and the reference-current element; a third transistor connected in series with the third reference-current element; a bypass capacitor connected between the power supply terminal and a second node connected to a control terminal of the third transistor; an activation circuit connected to the first node; and a first switch connected between the first node and the second node.

8 Claims, 9 Drawing Sheets

401

BIAS CIRCUIT

CROSS-REFERENCE TO RELATED APPLICATION

This application is based upon and claims the benefit of priority of the prior Japanese Patent Application No. 2013-083262, filed on Apr. 11, 2013, the entire contents of which are incorporated herein by reference.

FIELD

The embodiments discussed herein are related to a bias circuit.

BACKGROUND

In a conventional reference voltage generating circuit that includes a reference voltage generator configured to generate a reference voltage, a charge supply circuit, and a timer circuit, the charge supply circuit is controlled by the timer circuit so that an output (a power supply voltage, for example) from the charge supply circuit is supplied to a reference voltage output terminal of the reference voltage generator for a prescribed time, starting from a point in time at which the reference voltage generator was activated (see Japanese Laid-open Patent Publication No. 10-222234, for example). A capacitor is connected to the reference voltage output terminal of the reference voltage generator to stabilize its output.

In the conventional reference voltage generating circuit, however, a time during which the timer circuit performs counting is preset. If, for example, a power supply voltage is slowly raised, therefore, the counting time preset in the timer circuit may be too short for the output electric potential of the reference voltage generator to rise sufficiently. This may cause slow start-up operation. If a capacitor for smoothing the output voltage of the reference voltage generator is reduced to achieve fast start-up operation, variations in the power supply voltage and noise influence may become significant.

Accordingly, the conventional reference voltage generating circuit may not be capable of achieving both a high power supply rejection ratio (PSRR) and quick start-up operation.

SUMMARY

According to an aspect of the invention, a bias circuit includes: a reference current generation circuit that has a first reference-current element disposed in a first current path and has a second reference-current element disposed in a second current path; a first current mirror circuit that has a first transistor connected in series with the first reference-current element and has a second transistor connected in series with the second reference-current element; a third reference-current element disposed in a third current path disposed between the power supply terminal and the reference-current element; a third transistor connected in series with the third reference-current element; a bypass capacitor connected between the power supply terminal and a second node connected to a control terminal of the third transistor; an activation circuit connected to the first node; and a first switch connected between the first node and the second node.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A related bias circuit will be described with reference to FIGS. 1 to 3 before embodiments with the present disclosure are described.

Figure 1:
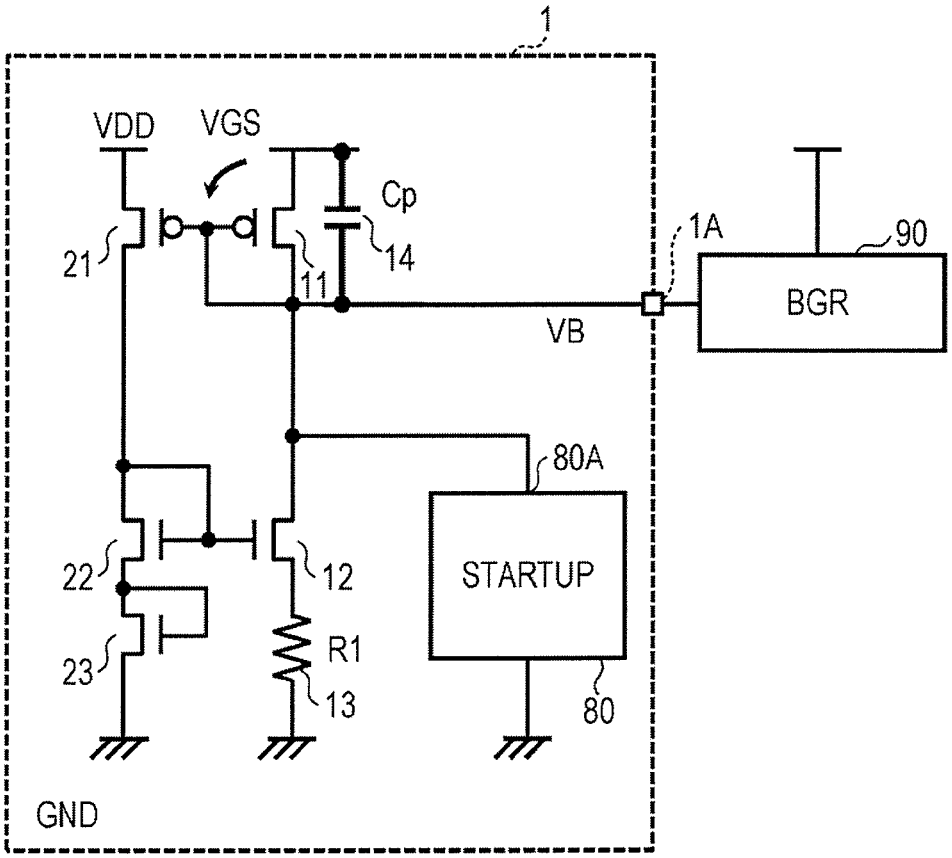
FIG. 1 RELATED ART
FIG. 1 illustrates a related bias circuit.

FIG. 1 illustrates a related bias circuit 1.

The bias circuit 1 includes a p-channel metal oxide semiconductor (PMOS) transistor 11, an n-channel metal oxide semiconductor (NMOS) transistor 12, a resistor 13, a bypass capacitor 14, a PMOS transistor 21, NMOS transistors 22 and 23, a startup circuit 80, and an output terminal 1A.

The source of the PMOS transistor 11 is connected to a power supply VDD and one end (upper terminal in FIG. 1) of the bypass capacitor 14. The drain of the PMOS transistor 11 is connected to its gate, the output terminal 1A, the other end (lower terminal in FIG. 1) of the bypass capacitor 14, the output terminal 80A of the startup circuit 80, and the drain of the NMOS transistor 12. The gate of the PMOS transistor 11 is connected to its drain and the gate of the PMOS transistor 21.

The PMOS transistor 11 forms a current mirror circuit together with the PMOS transistor 21. The bypass capacitor 14 is connected between the gate and source of the PMOS transistor 11.

The drain of the NMOS transistor 12 is connected to the drain and gate of the PMOS transistor 11, the output terminal 1A, and the output terminal 80A of the startup circuit 80. The source of the NMOS transistor 12 is connected to one end (upper terminal in FIG. 1) of the resistor 13. The gate of the NMOS transistor 12 is connected to the gate and drain of the NMOS transistor 22.

The NMOS transistor 12 forms a current mirror circuit together with the NMOS transistor 22. The NMOS transistor 12 and PMOS transistor 11 are vertically stacked; the main path between the drain and source of the NMOS transistor 12 and the main path between the drain and source of the PMOS transistor 11 are connected in series.

The one end (upper terminal in FIG. 1) of the resistor 13 is connected to the source of the NMOS transistor 12 and the other end (lower terminal in FIG. 1) is grounded. The resistance of the resistor 13 is R1.

The one end (upper terminal in FIG. 1) of the bypass capacitor 14 is connected to the source of the PMOS transistor 11 and the other end (lower terminal in FIG. 1) is connected to the gate of the PMOS transistor 11. That is, the one end of the bypass capacitor 14 is connected to the power supply VDD and the other end is connected to the output terminal 1A.

The drain of the NMOS transistor 23 is connected to its gate and the source of the NMOS transistor 22. The source of the NMOS transistor 23 is grounded. The NMOS transistor 23 and NMOS transistor 22 are vertically stacked; the main path between the drain and source of the NMOS transistor 22 and the main path between the drain and source of the NMOS transistor 23 are connected in series.

The output terminal 1A is an output terminal of the bias circuit 1. A band gap reference (BGR) circuit 90 is connected to the output terminal 1A.

Here, the voltage at the output terminal 1A is denoted VB. The BGR circuit 90 receives the output voltage VB from the bias circuit 1 and outputs a prescribed reference voltage.

The startup circuit 80 temporarily switches the voltage at the output terminal 80A to a ground voltage at the start-up phase of the bias circuit 1. When the output voltage of the startup circuit 80 is temporarily switched to the ground voltage, the bias circuit 1 is activated.

When the output voltage at the output terminal 80A of the startup circuit 80 is switched from a prescribed positive voltage to the ground voltage in the bias circuit 1 of this type, the gate voltage of the PMOS transistor 11 goes low, so the PMOS transistors 11 and 21 are turned on.

When the PMOS transistor 21 is turned on, the gate voltages of the NMOS transistors 12 and 22 are raised, so the NMOS transistors 12 and transistor 22 are turned on. Thus, a current starts to flow in a current path including the PMOS transistor 11, NMOS transistor 12, and resistor 13.

When the NMOS transistor 22 is turned on, the NMOS transistor 23 is also turned on. Thus, a current flows in a current path including the PMOS transistor 21 and NMOS transistors 22 and 23.

Since the PMOS transistors 11 and 21 form a current mirror circuit, an identical current flows between the source and drain of the PMOS transistor 11 and between the source and drain of the PMOS transistor 21.

Since the NMOS transistors 12 and 22 also form a current mirror circuit, an identical current flows in them. At that time, the source voltages at the NMOS transistors 12 and 22 are almost the same, so the value of a current flowing in the current path is determined by the threshold voltage of the NMOS transistor 23 and the resistance R1 of the resistor 13.

The bias circuit 1 of this type is used a battery-driven unit such as a mobile terminal.

Analog circuits are integrated in a semiconductor circuit used in a mobile electronic unit such as a mobile terminal. Since the BGR circuit 90 can generate a stable reference voltage, it is widely used as a circuit that generates a reference voltage of an analog circuit.

To operate an analog circuit such as the BGR circuit 90, a bias current with a certain current value or a bias voltage with a certain voltage value is desirable. To supply this bias current or bias voltage, the bias circuit 1 is used.

The bias circuit 1 is expected to have two main characteristics described below. One of them is to maintain high stability against variations in a power supply voltage VDD, that is, to have a high power supply rejection ratio (PSRR). The other is to have the quick start-up operation to the rising of the power supply voltage VDD, that is, to enable that the output voltage VB is abruptly raised to a desired electric potential.

To achieve a high PSRR, the bypass capacitor 14 is generally inserted as illustrated in FIG. 1. Even if the power supply voltage VDD changes, the bypass capacitor 14 changes the output voltage VB to follow the change of the power supply voltage VDD. Therefore, a gate-source voltage VGS applied to the PMOS transistor 11 is maintained at a fixed level, stabilizing currents flowing in two current paths, one of which includes the PMOS transistor 11 and the other of which includes the PMOS transistor 21.

Next, the desirable quick start-up operation of the bias circuit 1 for the rising of the power supply voltage VDD will be described with reference to FIG. 2.

Figure 2:
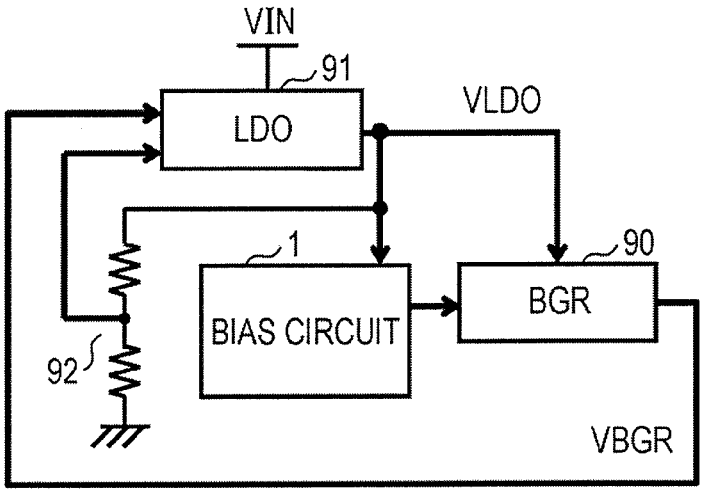
FIG. 2 RELATED ART
FIG. 2 illustrates a power supply circuit that includes the bias circuit in FIG. 1, a band gap reference (BGR) circuit, and a low dropout (LDO) circuit.

FIG. 2 illustrates a circuit that includes the bias circuit 1, the BGR circuit 90, and a low dropout (LDO) circuit 91.

When an input voltage VIN is input to the LDO circuit 91, it operates and outputs a prescribed output voltage VLDO. The output voltage VLDO from the LDO circuit 91 is input to the bias circuit 1 and BGR circuit 90 as a power supply voltage.

The output voltage VLDO from the LDO circuit 91 is divided by a voltage dividing circuit 92.

To output a desired output voltage VLDO, the LDO circuit 91 internally performs feedback control so that the output voltage VBGR of the BGR circuit 90 and the output voltage of the voltage dividing circuit 92 become the same. The desired output voltage VLDO is obtained by setting the resistance ratio between two resistors in the voltage dividing circuit 92 to an appropriate value.

Figure 3:
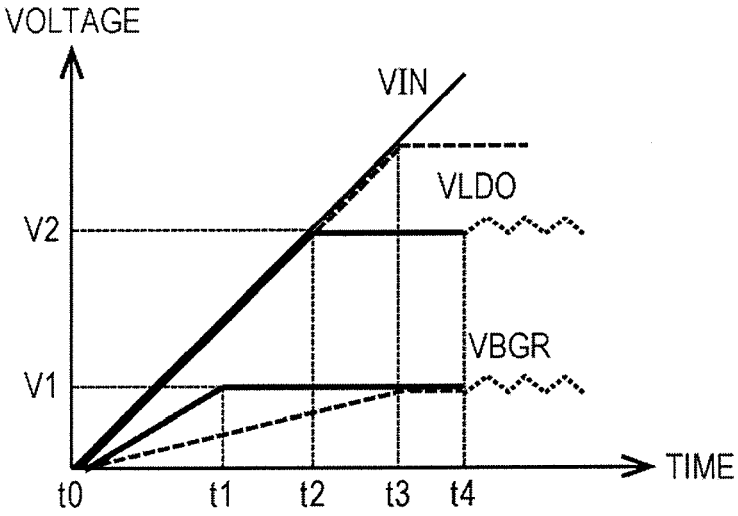
FIG. 3 RELATED ART
FIG. 3 is a graph indicating the waveforms of the power supply circuit in FIG. 2 that includes an input voltage VIN, an output voltage VLDO, and an output voltage VBGRat the activation of the bias circuit, BGR circuit, and LDO power supply circuit in FIG. 2.

FIG. 3 is a graph indicating the waveforms of the input voltage VIN, output voltage VLDO, and output voltage VBGR at the start-up phase of the bias circuit 1, BGR circuit 90, and LDO circuit 91. FIG. 3 illustrates a state in which the input voltage terminal VIN is connected to a battery in a mobile terminal and the VIN voltage is gradually supplied, starting from a time t0 at which the input voltage terminal VIN is not connected to the battery, that is, VIN is 0. Particularly, FIG. 3 is an enlarged view at the moment at which the input voltage VIN has been supplied.

The output voltage VLDO is a voltage that is input to the bias circuit 1 illustrated in FIG. 1 as the power supply voltage VDD.

To raise the output voltage VLDO and maintain it at a fixed level, it is desirable to start up the BGR circuit 90 first and adjust the output voltage VLDO of the LDO circuit 91 with reference to the output voltage VBGR of the BGR circuit 90. Accordingly, the output voltage VBGR is ideally raised first before time t1 is reached as indicated by a solid line in FIG. 3, after which the output voltage VLDO is stabilized at a fixed value at time t2 under internal feedback control.

To obtain a high PSRR, a case will be now considered in which, for example, the capacitance Cp of the bypass capacitor 14 has been largely increased to stabilize operation. In this case, the start-up operation of the bias circuit 1 (completion of the rising of the output voltage VB) is delayed, delaying the rising of the output voltage VBGR of the BGR circuit 90.

As a result, a time (t0 to t3) taken until the output voltage VBGR reaches a prescribed reference voltage V1 is prolonged, so feedback control is continued for a long time to raise the output voltage of the LDO circuit 91, as indicated by a broken line in FIG. 3.

In this case, the output voltage VLDO of the LDO circuit 91 becomes higher than the prescribed voltage V2 as indicated by another broken line and exceeds the withstand voltage of a transistor included in the LDO circuit 91. This may destroy the LDO circuit 91.

For these reasons, quick start-up operation is desirable for the bias circuit 1.

A case will be now considered in which, for example, the bypass capacitor 14 is not included in the bias circuit 1 to achieve quick start-up operation of the bias circuit 1.

In this case, the bias circuit 1 is activated quickly and the output voltage VBGR is also raised quickly, but the output voltage VBGR is easily affected by changes of the power supply voltage VDD (=VLDO) after completion of start-up operation, as indicated by a short dotted line after time t4, making it difficult to obtain a high PSRR.

As described above, if the bypass capacitor 14 is inserted between the source and drain of the PMOS transistor 11 in the bias circuit 1, the quick start-up operation is impeded. If the bypass capacitor 14 is not used, a high PSRR is not obtained easily. That is, it becomes difficult to achieve both a high PSRR and quick start-up operation.

In embodiments described below, a bias circuit that achieves both a high PSRR and quick start-up operation is provided.

Figure 4:
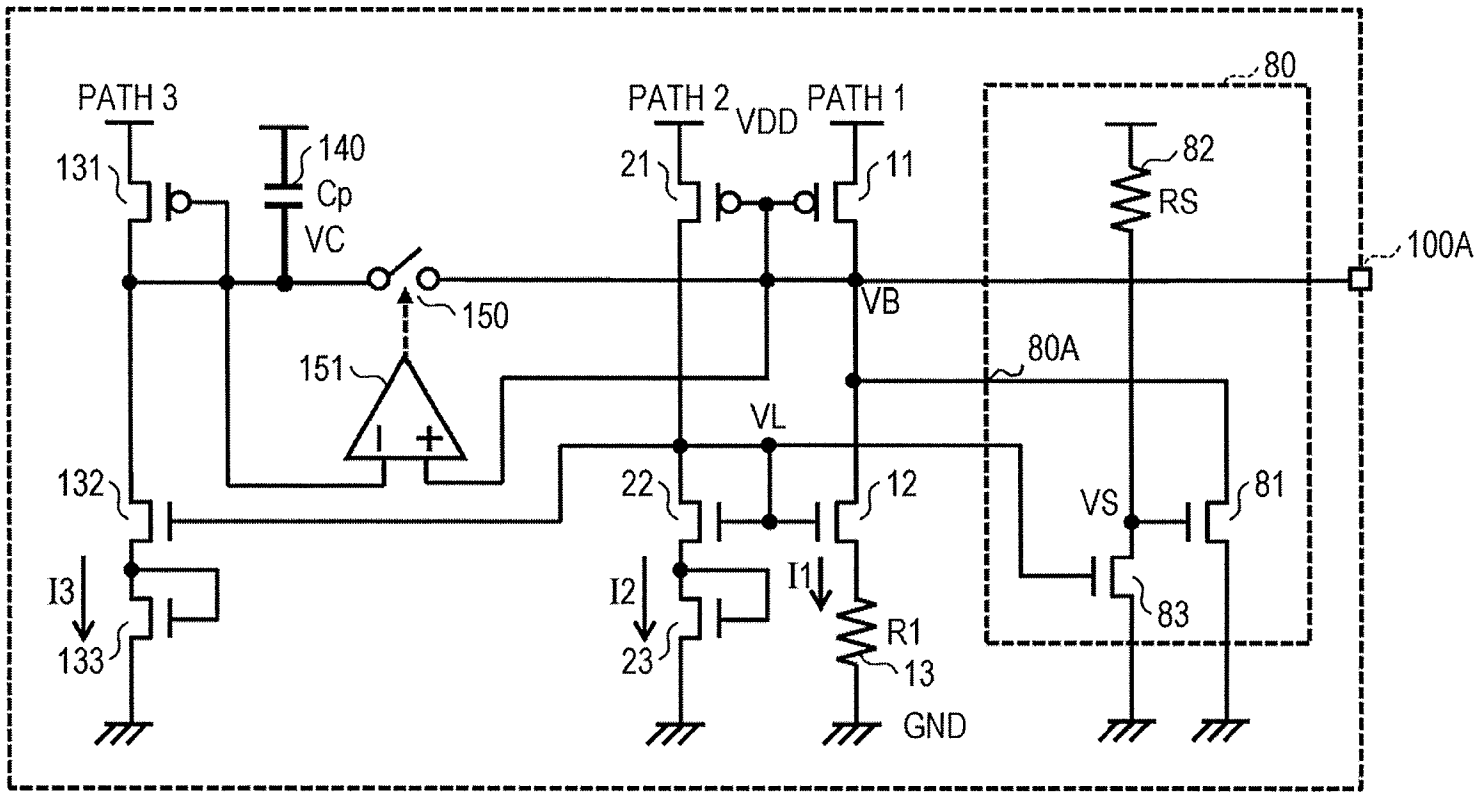
FIG. 4 illustrates another bias circuit.

FIG. 4 illustrates the bias circuit 100.

The bias circuit 100 includes the PMOS transistor 11, the NMOS transistor 12, the resistor 13, the PMOS transistor 21, the NMOS transistors 22 and 23, the startup circuit 80, and an output terminal 100A.

The bias circuit 100 further includes a PMOS transistor 131, an NMOS transistors 132 and 133, a bypass capacitor 140, a switch 150, and a comparator 151.

Elements in the bias circuit 100 that are the same as in the bias circuit 1 are given the same reference numerals, and their specific descriptions will be omitted.

The bias circuit 100 receives the output voltage VLDO from the LDO circuit 91 illustrated in FIG. 2 as the power supply voltage VDD of the bias circuit 1, and outputs a prescribed output voltage (bias voltage) VB from the output terminal 100A. The output terminal 100A is connected to the BGR circuit 90 in FIG. 2, as with, for example, the output terminal 1A of the bias circuit 1. The bias circuit 100 supplies the prescribed output voltage VB to the BGR circuit 90.

After the bias circuit 100 has been activated, the output voltage VB output from the bias circuit 100 is raised and is stabilized.

In the bias circuit 100, a current path including the PMOS transistor 11, NMOS transistor 12, and resistor 13 will be referred to as path 1, and a current path including the PMOS transistor 21 and NMOS transistors 22 and 23 will be referred to as path 2.

A current path including the PMOS transistor 131, NMOS transistors 132 and 133 will be referred to as path 3.

Path 1, path 2, and path 3 are respectively examples of a first current path, a second current path, and a third current path.

The PMOS transistor 11 is an example of a first transistor, and the PMOS transistor 21 is an example of a second transistor. The current mirror circuit formed with the PMOS transistors 11 and 21 is an example of first current mirror circuit.

An output node indicating the output voltage VB of the bias circuit 100 will be referred to as the node VB. The node VB is an example of a first node.

A circuit formed with the NMOS transistor 12 and resistor 13 is an example of a first reference current element, and a circuit formed with the NMOS transistors 22 and 23 is an example of a second reference current element.

A circuit formed with a pair of the NMOS transistor 12 and resistor 13 and a pair of the NMOS transistors 22 and 23 is an example of a reference current generating unit. The NMOS transistors 12 and 22 included in the reference current generating unit is an example of a third current mirror circuit. In the reference current generating unit, an operation point is determined so that one end (upper terminal in FIG. 4) of the resistor 13 and the drain of the NMOS transistor 23 have the same electric potential.

As a result, current I2 (I2=Vth/R1), which is determined by the threshold voltage Vth of the NMOS transistor 23 and the resistance R1 of the resistor 13, flows in path 2.

Current I1 flowing in path 1 is determined by the current ratio of the current mirror circuit formed with the NMOS transistors 12 and 22.

In this embodiment, the startup circuit 80 includes the output terminal 80A, an NMOS transistor 81, a resistor 82, and an NMOS transistor 83.

The drain of the NMOS transistor 81 is connected to the output terminal 80A, and the source of the NMOS transistor 81 is grounded. The gate of the NMOS transistor 81 is connected between the resistor 82 and the drain of the NMOS transistor 83. Now, the gate voltage of the NMOS transistor 81 will be denoted VS, and the resistance of the resistor 82 will be denoted RS.

One end (upper terminal in FIG. 4) of the resistor 82 is connected to the power supply VDD, and the other end (lower terminal in FIG. 4) is connected to the gate of the NMOS transistor 81 and the drain of the NMOS transistor 83.

The source of the NMOS transistor 83 is grounded, and its gate is connected to the gates of the NMOS transistors 12 and 22, the drain of the NMOS transistor 22, and the gate of the NMOS transistor 132.

Now, the gate voltage of the NMOS transistor 83 will be denoted VL.

In the startup circuit 80, when the power supply voltage VDD is raised at the start-up phase of the bias circuit 100, the gate voltage VS of the NMOS transistor 81 is raised, so the NMOS transistor 81 is first turned on. Thus, the voltage at the output terminal 80A drops to a ground voltage (low (L) level).

When the output voltage VB goes low, the PMOS transistors 11 and 21 are turned on, causing the voltage VL goes high (high (H) level). Therefore, the NMOS transistors 12 and 22 are turned on, and a current flows in path 1 first, immediately after which the NMOS transistor 23 is turned on, causing a current to flow in path 2.

When the voltage VL is raised to the high level, the NMOS transistor 83 is turned on, so the gate voltage VS of the NMOS transistor 81 drops to the ground voltage (L level), turning off the NMOS transistor 81.

That is, the NMOS transistor 81 in the startup circuit 80 is turned on immediately after the bias circuit 100 has been activated. When a current then flows in the PMOS transistors 11 and 21, the voltage VL is raised to the high level, the NMOS transistor 81 is turned off. Therefore, when a current flows in path 1 and path 2 once due to a startup, feedback control is performed by two current mirror circuits formed with the PMOS transistors 11 and 21 and by the NMOS transistors 12 and 22 so that the current becomes 12, making the current stable and fixed. Thus, the output voltage VB becomes a fixed value.

The source of the PMOS transistor 131 is connected to the power supply VDD. The drain of the PMOS transistor 131 is connected to its gate, the drain of the NMOS transistor 132, the other end (lower terminal in FIG. 4) of the bypass capacitor 140, and one end (left terminal in FIG. 4) of the switch 150.

The drain of the NMOS transistor 132 is connected to the drain and gate of the PMOS transistor 131, the other end (lower terminal in FIG. 4) of the bypass capacitor 140, and the one end (left terminal in FIG. 4) of the switch 150.

The source of the NMOS transistor 132 is connected to the drain and gate of the NMOS transistor 133. The gate of the NMOS transistor 132 is connected through the node VL to the gates of the NMOS transistors 12 and 22, the drain of the NMOS transistor 22, and the gate of the NMOS transistor 83. The source of the NMOS transistor 133 is grounded and its gate is connected to its drain.

The PMOS transistor 131 and NMOS transistors 132 and 133, which constitute path 3, are structured in the same way as the PMOS transistor 21 and NMOS transistors 22 and 23, which constitute path 2.

The PMOS transistor 131 forms a current mirror circuit together with the PMOS transistor 21. This current mirror circuit is an example of a second current mirror circuit.

The NMOS transistor 132 forms a current mirror circuit together with the NMOS transistor 22. This current mirror circuit is an example of a fourth current mirror circuit.

The reason why the NMOS transistor 133 is stacked vertically on the ground side of the NMOS transistor 132 is to form the same vertically stacked structure in which the NMOS transistor 23 is stacked on the ground side of the NMOS transistor 22 so that an equivalent current flows in the NMOS transistor 23 and NMOS transistor 133.

The circuit formed with the NMOS transistors 132 and 133 is an example of a third reference current element.

One end (upper terminal in FIG. 4) of the bypass capacitor 140 is connected to the power supply VDD. The other end (lower terminal in FIG. 4) of the bypass capacitor 140 is connected to the gate and drain of the PMOS transistor 131, the drain of the NMOS transistor 132, one end (left terminal in FIG. 4) of the switch 150, and the inverting input terminal of the comparator 151.

Now, the voltage at the other end of the bypass capacitor 140 will be denoted VC, and its relevant node will be referred to as the node VC. The node VC is an example of a second node.

One end (left terminal in FIG. 4) of the switch 150 is connected to the node VC, and the other end (right terminal in FIG. 4) is connected to the node VB. The control terminal of the switch 150 is connected to the output terminal of the comparator 151. When the output of the comparator 151 is high (H level), the switch 150 is turned on. When the output of the comparator 151 is low (L level), the switch 150 is turned off.

The switch 150 is implemented by, for example, an NMOS transistor having a gate connected to the output terminal of the comparator 151. The switch 150 is an example of a first switch.

The inverting input terminal of the comparator 151 is connected to the node VC, the non-inverting input terminal of the comparator 151 is connected to the node VB, and the output terminal of the comparator 151 is connected to the control terminal of the switch 150. The comparator 151 compares the electric potentials at the node VB and node VC. If the electric potential at the node VB is lower than the electric potential at the node VC, the comparator 151 outputs a low-level signal from the output terminal. If the electric potential at the node VB is higher than or equal to the electric potential at the node VC, the comparator 151 outputs a high-level (H level) signal.

Operation of the bias circuit 100 in FIG. 4 will be described below.

When the power supply voltage VDD is raised and the startup circuit 80 is activated, the comparator 151 is first set so that it produces a low output. To have the comparator 151 produce a low output, the node VC is set so as to have an electric potential higher than at the node VB by, for example, a method described in (1) or (2) below.

(1) A current that temporarily flows at the activation of the startup circuit 80 is made higher than a current flowing in the interior of the comparator 151 so that the startup circuit 80 operates faster than the comparator 151. Thus, the electric potential at the node VB responds faster than the electric potential at the node VC, so the electric potential at the VB node becomes lower than the electric potential at the VC node. As a result, the output of the comparator 151 goes low at the activation of the startup circuit 80.

(2) A current flowing in path 1 is made higher than a current flowing in path 3. Thus, the electric potential at the node VB responds faster than the electric potential at the node VC, so the electric potential at the VB node becomes lower than the electric potential at the VC node. As a result, the output of the comparator 151 goes low (L level) at the activation of the startup circuit 80.

The bias circuit 100 may be set so that both (1) and (2) are satisfied.

When a current flows in the startup circuit 80 once at the time of activation, a current flows in the PMOS transistors 11 and 21, lowering the electric potential at the node VB. The current is then copied by the current mirror circuit formed with the NMOS transistors 22 and 12. Current feedback control is performed between path 1 and path 2, and current I2 (=Vth/R1) is finally stabilized at a fixed level. Since the output of the comparator 151 is low at the activation of the startup circuit 80, the output voltage VB may be quickly raised with the switch 150 turned off, that is, with the bypass capacitor 140 disconnected from the output voltage VB, during activation of the bias circuit 100.

When a current flows in path 2, current I3 starts to flow in path 3 through the second current mirror circuit formed with the NMOS transistors 22 and 132.

Since path 3 has the same circuit structure as path 2, current I3 flowing in path 3 is equivalent to current I2 flowing in path 2. The electric potential at the node VC is equal to the power supply voltage VDD at an initial state, in which no current is flowing in path 3. When a current flows in path 3, the electric potential at the node VC gradually drops from the power supply voltage VDD. If a time taken until the electric potential at the node VC reaches the stable electric potential VC is t, then t is determined by Cp×(VDD−VC)/I3. Since the bypass capacitor 140 is connected, a change in the electric potential at the node VC is delayed by the time t when compared with the electric potential at the node VB.

When the electric potential at the node VC drops after that and becomes lower than or equal to the electric potential at the node VB, the output signal from the comparator 151 goes high and the switch 150 is turned on. Thus the node VB and node VC are connected together and have the same electric potential.

When the switch 150 is turned on, a state in which the bypass capacitor 140 is connected between the gate and source of the PMOS transistor 11 is established, so the gate-source voltage VGS applied to the PMOS transistor 11 may be maintained at a fixed level.

As a result, the current flowing in path 1 including the PMOS transistor 11 and the current flowing in path 2 including the PMOS transistor 21 can be stabilized, so a high PSRR may be achieved.

As described above, in the bias circuit 100, the output voltage VB may be quickly raised by separating the node VB in the first current mirror circuit formed with the PMOS transistors 11 and 21, which are respectively included in path 1 and path 2, from the bypass capacitor 140 by the switch 150.

The bypass capacitor 140 is connected between the gate and source of the PMOS transistor 131 in path 3, and the switch 150 is turned on and the node VB and node VC are connected together when the output voltage VB is activated. After the output voltage VB has been activated, therefore, a high PSRR may be achieved.

In this embodiment, therefore, the bias circuit 100 that achieves both a high PSRR and quick start-up operation may be provided.

Simulation results in the bias circuit 100 will be described below with reference to FIGS. 5A to 5C. In the simulations, the bias circuit 100 in FIG. 4 will be used instead of the bias circuit 1 in FIG. 2.

Figure 5A:
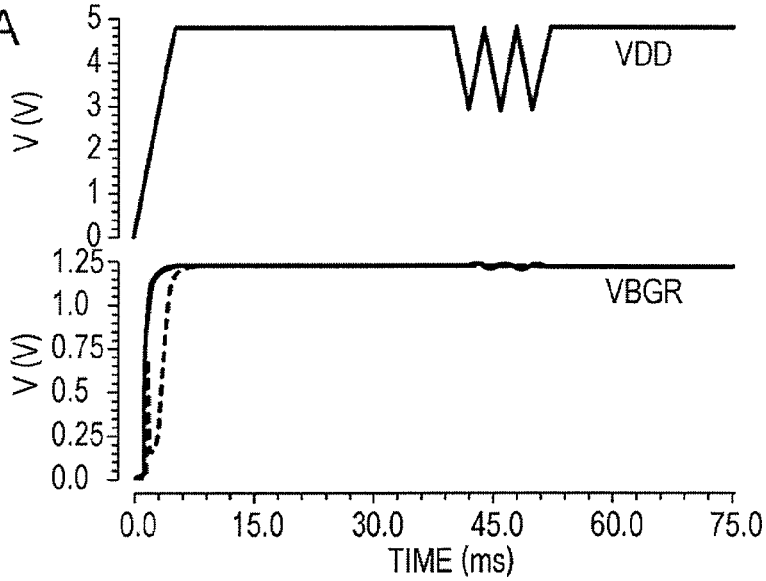
FIGS. 5A, 5B, and 5C illustrate simulation results in the bias circuit in FIG. 4.
Figure 5B:
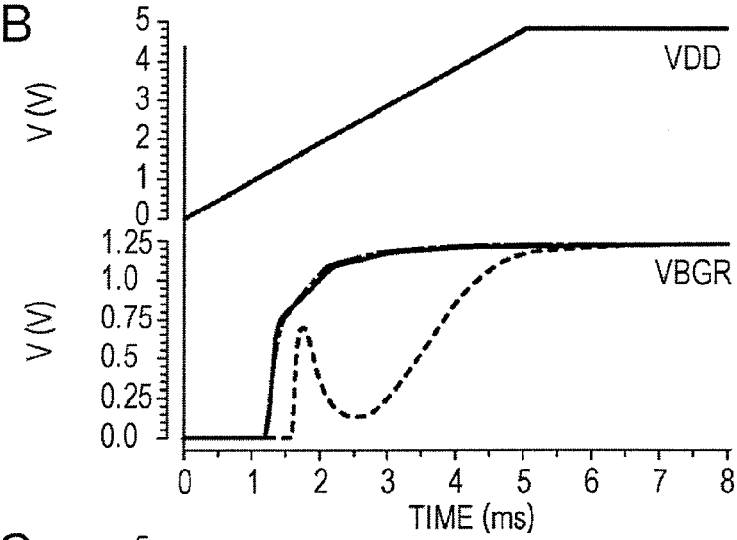
Figure 5C:
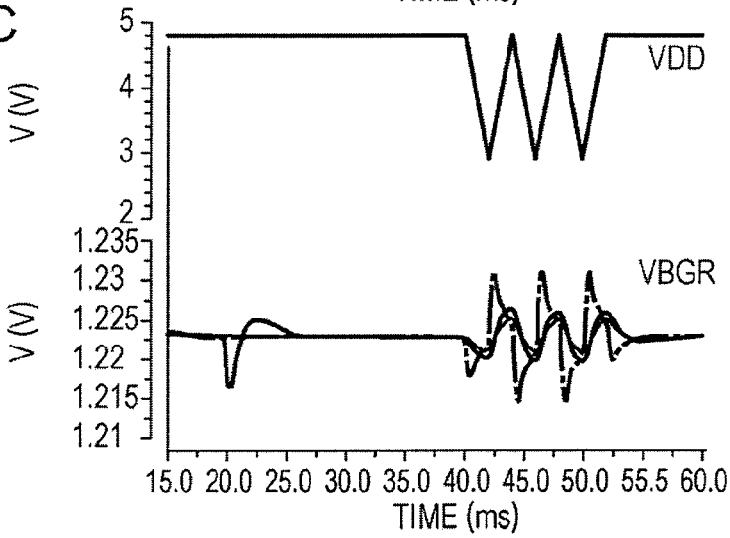

FIGS. 5A to 5C illustrate simulation results in the bias circuit 100. Specifically, FIG. 5A illustrates the operating waveform of the power supply voltage VDD (upper) and the operating waveform of the output voltage VBGR in the BGR circuit 90 (lower). FIG. 5B illustrates operating waveforms at an initial stage (at a startup time) in FIG. 5A, the operating waveforms being enlarged in the time axis direction. In FIG. 5B as well, the upper waveform is the operating waveform of the power supply voltage VDD and the lower waveform is the operating waveform of the output voltage VBGR in the BGR circuit 90.

FIG. 5C illustrates operating waveforms, in FIG. 5A, that are obtained when the power supply voltage VDD changes, the operating waveforms being enlarged in the time axis direction. In FIG. 5C as well, the upper waveform is the operating waveform of the power supply voltage VDD and the lower waveform is the operating waveform of the output voltage VBGR in the BGR circuit 90.

For comparison purposes, FIGS. 5A to 5C also illustrate simulation results of the output voltage VBGR that have been calculated for the bias circuit 1 (see FIG. 1) in a case in which the bypass capacitor 14 (see FIG. 1) was included or excluded.

As indicated by the upper operating waveforms in FIGS. 5A and 5B, the power supply voltage VDD was linearly raised at the startup of the bias circuit 100. As indicated by the lower operating waveforms in FIGS. 5A and 5B, the output voltage VBGR in the bias circuit 100 were quickly raised (particularly as indicated by the lower operating waveform in FIG. 5B).

The speed at which the output voltage VBGR was raised was as quickly as when the bypass capacitor 14 was removed from the bias circuit 1.

The broken line in the lower portion in FIG. 5B indicates the output voltage VBGR in the bias circuit 1 including the bypass capacitor 14. The rising edge of the output voltage VBGR was significantly delayed as compared with the rising edge of the output voltage VBGR in the bias circuit 100.

Thus, it was found that the bias circuit 100 could achieve quick start-up operation.

When the power supply voltage VDD was changed as indicated by the upper operating waveforms in FIGS. 5A and 5C, changes in the output voltage VBGR in the BGR circuit 90 in the bias circuit 100 were small as indicated by the lower operating waveform in FIG. 5C.

When time t is about 20.0 ms, these changes were about as small as in noise generated as a result of the connection of the bypass capacitor 140; changes in the electric potential of the output voltage VBGR were ±0.5% or less. Accordingly, the output voltage VBGR was stable at a non-problematic level. The capacitance of the bypass capacitor 140 is designed by using an equation $Cp=(t\times I3)/(VDD-VC)$, which is derived from the equation described above, so that the switch 150 is turned on after the electric potential at the node VB has been completely raised. The broken line in the lower portion in FIG. 5C indicates the output voltage VBGR in the bias circuit 1 including the bypass capacitor 14. The output voltage VBGR was also stable.

The dash-dot line in the lower portion in FIG. 5C indicates the output voltage VBGR in the bias circuit 1 without the bypass capacitor 14; the output voltage VBGR was largely changed.

Thus, the bias circuit 100 was found to have achieved a high PSRR. The PSRR of the bias circuit 100 indicated almost the same characteristics as the PSRR of the bias circuit 1 including the bypass capacitor 14.

As a form of the circuit in FIG. 4, a circuit formed with the NMOS transistor 12, resistor 13, and NMOS transistors 22 and 23 has been included in path 1 and path 2, as an example of the reference current generating unit.

However, the circuit structure of the reference current generating unit is not limited to the circuit in FIG. 4. If the reference current generating unit can be formed by the PMOS transistor 11 in the path 1 and the PMOS transistor 21 in the path 2, the reference current generating unit may have another circuit structure.

In this case, it suffices that a third transistor disposed with the PMOS transistor 131 in path 3 is similar to the circuit with the PMOS transistor 21 in path 2.

So far, a form has been described in which path 3 has a circuit structure similar to the circuit structure of path 2 and current I3 flowing in path 3 is equal to current I2 flowing in path 2.

However, the value of current I3 may also be a value taken when the current ratio (ratio of transistor sizes) of the second current mirror circuit formed with the NMOS transistors 22 and 132 is changed, that is, when current I3 and current I2 have different values.

Figure 6:
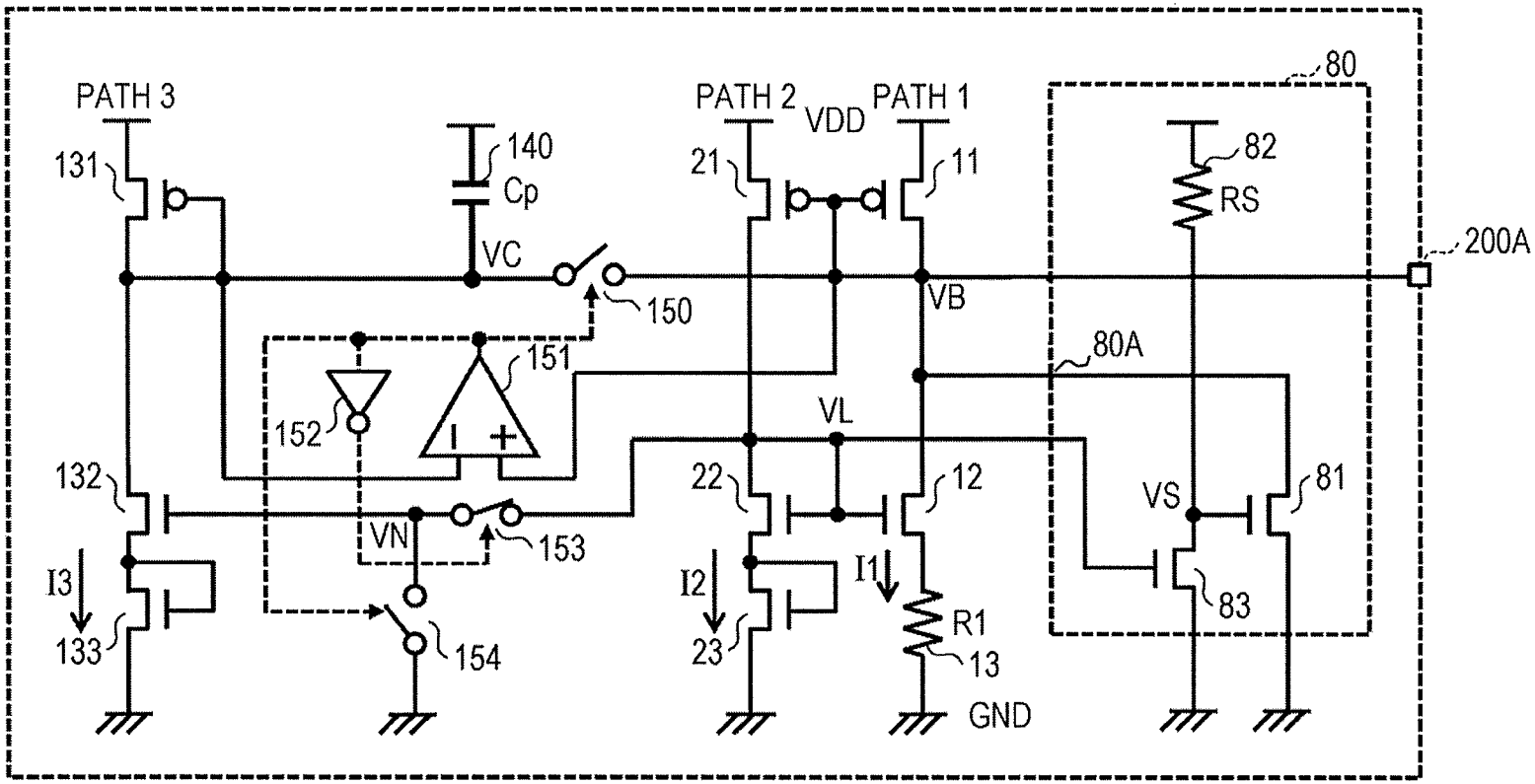
FIG. 6 illustrates yet another bias circuit.

FIG. 6 illustrates a bias circuit 200.

The bias circuit 200 differs from the bias circuit 100 in that an inverter 152 and switches 153 and 154 are added. Since other structures are the same as in the bias circuit 100, like elements are assigned like reference numerals, and their descriptions will be omitted.

The input terminal of the inverter 152 is connected to the output terminal of the comparator 151, and the output terminal of the inverter 152 is connected to the control terminal of the switch 153.

One end (left terminal in FIG. 6) of the switch 153 is connected to the gate of the NMOS transistor 132, and the other end (right terminal in FIG. 6) is connected to the gates of the NMOS transistors 12 and 22 and the drain of the NMOS transistor 22. The control terminal of the switch 153 is connected to the output terminal of the inverter 152. The switch 153 is an example of a second switch.

The position at which the switch 153 is inserted is between the node VL and the NMOS transistors 132 in the bypass circuit 100.

The switch 153 is implemented by, for example, an NMOS transistor having a gate connected to the output terminal of the inverter 152. The switch 153 is turned on when the output of the inverter 152 is high, and is turned off when the output is low. That is, the switch 153 is turned on and off in a phase opposite to the phase of the switch 150.

Now, a node between one end (left terminal in FIG. 6) of the switch 153 and the gate of the NMOS transistor 132 will be referred to as the node VN.

One end (upper terminal in FIG. 6) of the switch 154 is connected to the node VN, and the other end (lower terminal in FIG. 6) is grounded. The control terminal of the switch 154 is connected to the output terminal of the comparator 151. The switch 154 is an example of a third switch.

The switch 154 is implemented by, for example, an NMOS transistor having a gate connected to the output terminal of the comparator 151. The switch 154 is turned on when the output of the comparator 151 is high, and is turned off when the output is low.

At start-up operation of the bias circuit 200 described above, the electric potential at the node VB is lower than the electric potential at the node VC, so both the switch 150 and the switch 154 are turned off and the switch 153 is turned on. Therefore, the operation of the bias circuit 200 at a startup time is the same as in the bias circuit 100.

When the electric potential at the node VC is lower than the electric potential at the node VB and the output of the comparator 151 thereby changes to a high level, the switches 150 and 154 are turned on and the switch 153 is turned off.

When the switch 150 is turned on, the node VB is connected to the node VC, stabilizing the output terminal 200A of the bias circuit 200.

When the switch 153 is turned off and the switch 154 is turned on, the electric potential at the node VN drops to a low level, so the NMOS transistor 132 is turned off. Thus, the current I3 does not flow in path 3, enabling power consumption to be reduced after activation.

In this embodiment, therefore, the bias circuit 200 that achieves both a high PSRR and quick start-up operation and also reduces power consumption may be provided.

Figure 7:
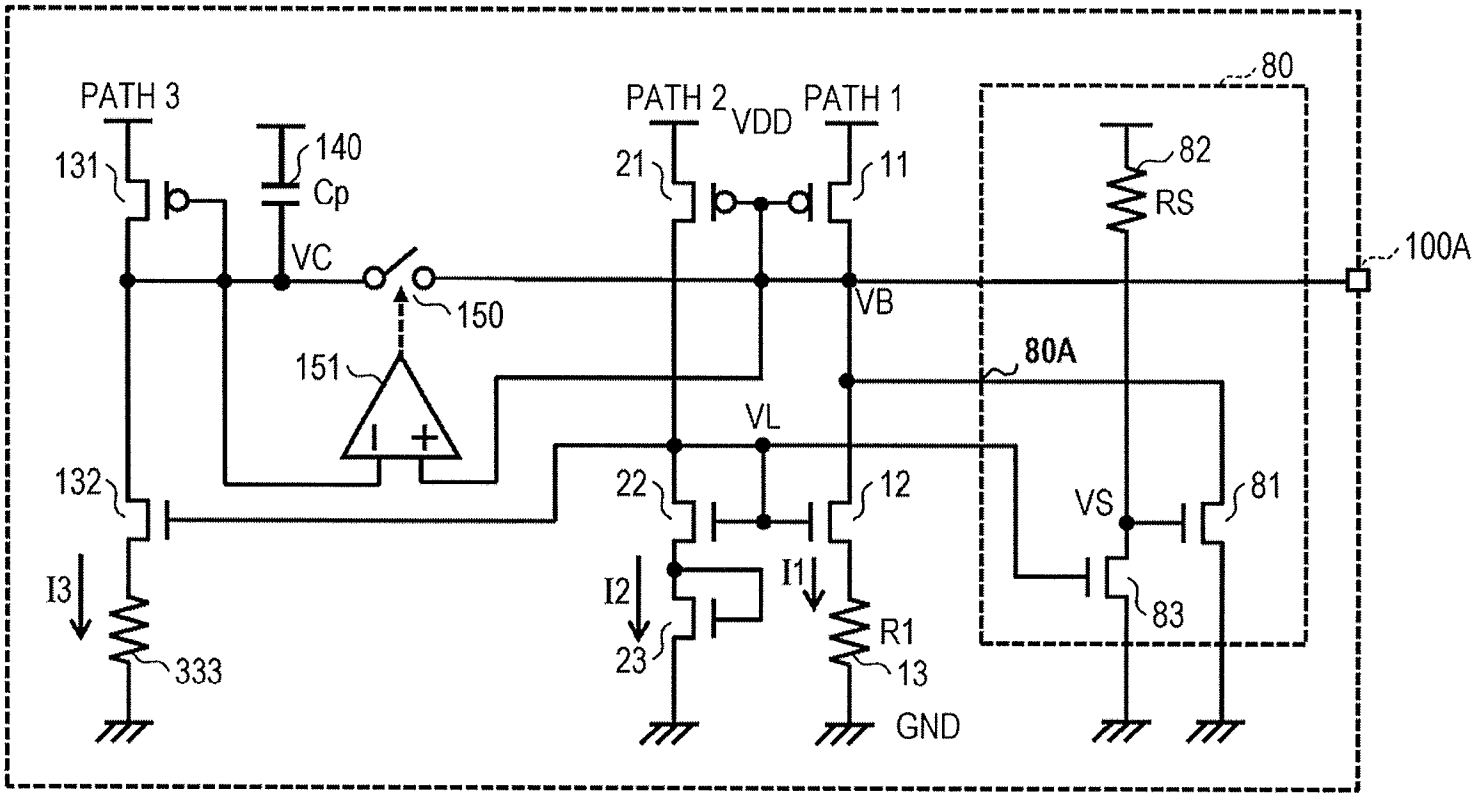
FIG. 7 illustrates still another bias circuit.

FIG. 7 illustrates a bias circuit 300.

The bias circuit 300 differs from the bias circuit 100 in that the NMOS transistor 133 in the bias circuit 100 is replaced with a resistor 333. Since other structures are the same as in the bias circuit 100, like elements are assigned like reference numerals, and their descriptions will be omitted.

One end (upper terminal in FIG. 7) of the resistor 333 is connected to the source of the NMOS transistor 132, and the other end (lower terminal in FIG. 7) is grounded. The resistance of the resistor 333 is R1, which is the same as the resistance of the resistor 13.

The bias circuit 300 operates in the same way as the bias circuit 100, except that current I3 flowing in path 3 is the same as current I1 flowing in path 1. That is, current I3 flowing in path 3 is a replica of current I1 flowing in path 1.

In this embodiment, the bias circuit 300 that achieves both a high PSRR and quick start-up operation may be provided.

Current I3 flowing in path 3 may be determined depending on whether it is appropriate to form the NMOS transistor 133 as in the bias circuit 100 or whether it is appropriate to form the resistor 333 as in the bias circuit 300.

Figure 8:
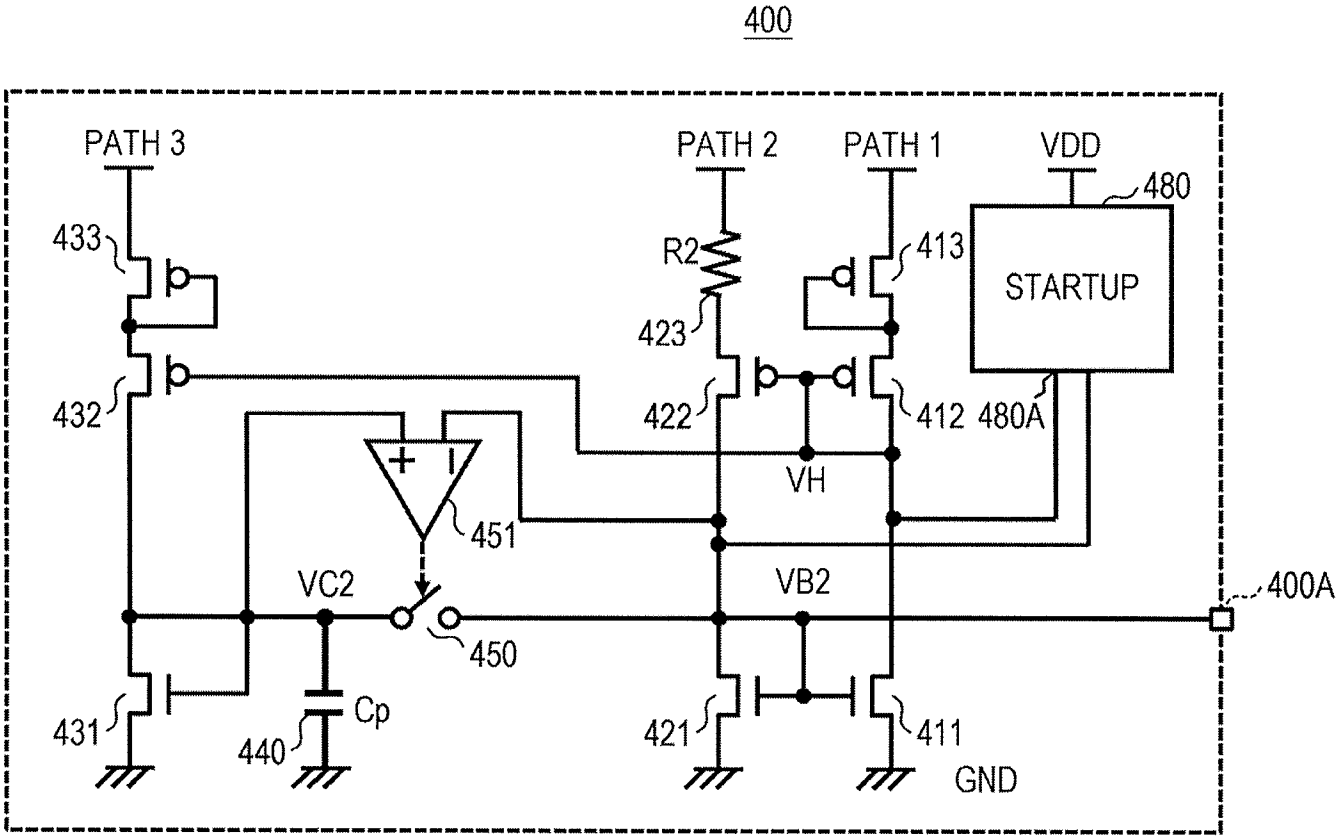
FIG. 8 illustrates still another bias circuit.

FIG. 8 illustrates a bias circuit 400.

The bias circuit 400 has the same structure as the bias circuit 100, except that connections of the elements between the power supply VDD and GND are reversed and the PMOS transistors and NMOS transistors are exchanged.

The bias circuit 400 includes an NMOS transistor 411, PMOS transistors 412 and 413, an NMOS transistor 421, a PMOS transistor 422, a resistor 423, a startup circuit 480, and an output terminal 400A.

The bias circuit 400 further includes an NMOS transistor 431, PMOS transistors 432 and 433, a bypass capacitor 440, a switch 450, and a comparator 451.

The bias circuit 400 receives the output voltage VLDO from the LDO circuit 91 illustrated in FIG. 2 as the power supply voltage VDD as shown in the bias circuit 1, and outputs a prescribed output voltage (bias voltage) VB2 from the output terminal 400A. The output terminal 400A is connected to the BGR circuit 90 in FIG. 2, as the output terminal 1A of the bias circuit 1. The bias circuit 400 supplies the prescribed output voltage VB2 to the BGR circuit 90.

In the bias circuit 400, a current path including the NMOS transistor 411 and PMOS transistors 412 and 413 will be referred to as path 1, and a current path including the NMOS transistor 421, PMOS transistor 422, and resistor 423 will be referred to as path 2.

A current path including the NMOS transistor 431 and PMOS transistors 432 and 433 will be referred to as path 3.

Path 1, path 2, and path 3 are respectively examples of the first current path, second current path, and third current path.

The drain of the NMOS transistor 411 is connected to the drain and gate of the PMOS transistor 412, the gate of the PMOS transistor 422, the gate of the PMOS transistor 432, and the output terminal of the startup circuit 480. The drain of the NMOS transistor 411 is connected through the terminal of the startup circuit 480 such as shown in the gate of the NMOS transistor 83 in FIG. 6.

The source of the NMOS transistor 411 is grounded and its gate is connected to the node VB2.

The node VB2 is connected to the gates of the NMOS transistors 411 and 421, the output terminal 400A of the bias circuit 400, the other end (right terminal in FIG. 8) of the switch 450, the output terminal 480A of the startup circuit 480, and the inverting input terminal of the comparator 451. The node VB2 is also connected through the output terminal 480A of the startup circuit 480 such as shown in the drain of the NMOS transistor 81 in FIG. 6.

The NMOS transistor 411 forms a current mirror circuit together with the NMOS transistor 421.

The source of the PMOS transistor 412 is connected to the drain and gate of the PMOS transistor 413.

The PMOS transistor 412 forms a current mirror circuit together with the PMOS transistor 422. The PMOS transistor 412 and NMOS transistor 411 are vertically stacked; the main path between the drain and source of the PMOS transistor 412 and the main path between the drain and source of the NMOS transistor 411 are connected in series.

Now, a node to which the output terminal 480A of the startup circuit 480 is connected as illustrated in FIG. 8 will be referred as the node VH.

The source of the PMOS transistor 413 is connected to the power supply VDD. The PMOS transistor 413 and PMOS transistor 412 are vertically stacked; the main path between the drain and source of the PMOS transistor 413 and the main path between the drain and source of the PMOS transistor 412 are connected in series.

The source of the NMOS transistor 421 is grounded. The drain and gate of the NMOS transistor 421 are connected to the node VB2.

The NMOS transistor 421 forms a current mirror circuit together with the NMOS transistor 411.

The drain of the PMOS transistor 422 is connected through the node VB2 to the gate of the NMOS transistor 411, the drain and gate of the NMOS transistor 421, and the inverting input terminal of the comparator 451.

The source of the PMOS transistor 422 is connected to the other end (lower terminal in FIG. 8) of the resistor 423. The gate of the PMOS transistor 422 is connected to the gate of the PMOS transistor 412 and is also connected through the node VH to the gate of the PMOS transistor 432.

The PMOS transistor 422 forms a current mirror circuit together with the PMOS transistor 412.

One end (upper terminal in FIG. 8) of the resistor 423 is connected to the power supply VDD, and the other end (lower terminal in FIG. 8) is connected to the source of the PMOS transistor 422. The resistance of the resistor 423 is R2.

The NMOS transistor 411 is an example of the first transistor. The NMOS transistor 421 is an example of the second transistor. The current mirror circuit formed with the NMOS transistors 411 and 421 is an example of first current mirror circuit.

An output node indicating the output voltage VB2 of the bias circuit 400 will be referred to as the node VB2. The node VB2 is an example of the first node.

A circuit formed with the PMOS transistors 412 and 413 is an example of the first reference current element, and a circuit formed with the PMOS transistor 422 and resistor 423 is an example of the second reference current element.

A circuit formed with a pair of the PMOS transistors 412 and 413 and a pair of PMOS transistor 422 and resistor 423 is an example of the reference current generating unit. The PMOS transistors 412 and 422 included in the reference current generating unit is an example of the third current mirror circuit. In the reference current generating unit, an operation point is determined so that the drain of the PMOS transistor 413 and the other end (lower terminal in FIG. 8) of the resistor 423 have the same electric potential.

As a result, current I1 (=Vthp/R2), which is determined by the threshold voltage Vthp of the PMOS transistor 413 and the resistance R2 of the resistor 423, flows in path 1.

Current I2 flowing in path 2 is determined by the current ratio of the current mirror circuit formed with the PMOS transistors 412 and 422.

When the power supply voltage VDD is raised at the activation of the bias circuit 400, the startup circuit 480 temporarily raises the voltage at the node VH to the power supply voltage VDD so that a current flows in the NMOS transistors 421 and 411. Although the interior of the startup circuit 480 is not drawn in detail in FIG. 8 to simplify it, the startup circuit 480 has the same structure as the startup circuit 80 in FIG. 4, except that connections of the elements between the power supply VDD and GND are reversed and the PMOS transistors and NMOS transistors are exchanged.

The source of the NMOS transistor 431 is grounded. The drain of the NMOS transistor 431 is connected to its gate and the drain of the PMOS transistor 432. The gate of the NMOS transistor 431 is connected to its drain, one end (upper terminal in FIG. 8) of the bypass capacitor 440, one end (left terminal in FIG. 8) of the switch 450, and the non-inverting input terminal of the comparator 451.

Now, a node to which the one end (upper terminal in FIG. 8) of the bypass capacitor 440 is connected will be referred as the node VC2. The node VC2 is an example of the second node.

The gate of the PMOS transistor 432 is connected to the node VH, and the source of the PMOS transistor 432 is connected to the drain and gate of the PMOS transistor 433. The source of the PMOS transistor 433 is connected to the power supply VDD. The NMOS transistor 431 and PMOS transistors 432 and 433, which constitute path 3, are structured in the same way as the structures of the NMOS transistor 411 and PMOS transistors 412 and 413, which constitute path 1.

The gate and drain of the NMOS transistor 431 are connected together. The NMOS transistor 431 forms a current mirror circuit together with the NMOS transistor 411. This current mirror circuit is an example of the second current mirror circuit.

The PMOS transistor 432 forms a current mirror circuit together with the PMOS transistor 412. This current mirror circuit is an example of the fourth current mirror circuit.

The reason why the PMOS transistor 433 is stacked vertically on the power supply VDD side of the PMOS transistor 432 is to form the same vertically stacked structure in which the PMOS transistor 413 is stacked on the power supply VDD side of the PMOS transistor 412 so that an equivalent current flows in the PMOS transistor 413 and PMOS transistor 433.

The circuit formed with the PMOS transistors 432 and 433 is an example of the third reference current element.

One end (upper terminal in FIG. 8) of the bypass capacitor 440 is connected to the node VC2. The other end (lower terminal in FIG. 8) of the bypass capacitor 440 is grounded.

One end (left terminal in FIG. 8) of the switch 450 is connected to the node VC2, and the other end (right terminal in FIG. 8) is connected to the node VB2. The control terminal of the switch 450 is connected to the output terminal of the comparator 451. When the output of the comparator 451 is high (H level), the switch 450 is turned on. When the output of the comparator 451 is low (L level), the switch 450 is turned off.

The switch 450 is implemented by, for example, an NMOS transistor having a gate connected to the output terminal of the comparator 451. The switch 450 is an example of the first switch.

The non-inverting input terminal of the comparator 451 is connected to the node VC2, the inverting input terminal of the comparator 451 is connected to the node VB2, and the output terminal of the comparator 451 is connected to the control terminal of the switch 450. The comparator 451 compares the electric potentials at the node VB2 and node VC2. If the electric potential at the node VC2 is lower than the electric potential at the node VB2, the comparator 451 outputs a low-level signal. If the electric potential at the node VC2 is higher than or equal to the electric potential at the node VB2, the comparator 451 outputs a high-level signal.

Operation of the bias circuit 400 in FIG. 8 will be described below.

When the power supply voltage VDD is raised and the startup circuit 480 is activated, the comparator 451 is first set so that it produces a low output. To have the comparator 451 produce a low output, the node VC2 is set so as to have an electric potential lower than at the node VB2 by, for example, a method described in (3) or (4) below.

(3) A current that temporarily flows at the activation of the startup circuit 480 is made higher than a current flowing in the interior of the comparator 451 so that the startup circuit 480 operates faster than the comparator 451. Thus, the electric potential at the node VB2 responds faster than the electric potential at the node VC2, so the electric potential at the VB2 node becomes higher than the electric potential at the VC2 node. As a result, the output of the comparator 451 goes low at the activation of the startup circuit 480.

(4) A current flowing in path 1 is made higher than a current flowing in path 3. Thus, the electric potential at the node VB2 responds faster than the electric potential at the node VC2, so the electric potential at the VB2 node becomes higher than the electric potential at the VC2 node. As a result, the output of the comparator 451 goes low at the activation of the startup circuit 480.

The bias circuit 400 may be set so that both (3) and (4) are satisfied.

When a current flows in the startup circuit 480 from the power supply VDD once at the time of activation, a current flows in the NMOS transistors 421 and 411, raising the electric potential at the node VB2. The current is then copied by the current mirror circuit formed with the PMOS transistors 412 and 422. Current feedback control is performed between path 1 and path 2, and current I1 (=Vthp/R2) is finally stabilized at a fixed level. Since the output of the comparator 451 is low at the activation of the startup circuit 480, the electric potential at the node VB2 can be quickly raised with the switch 450 turned off, that is, with the bypass capacitor 440 disconnected from the output voltage VB2, during activation of the bias circuit 400, so quick start-up operation may be achieved.

When a current flows in path 1, a current starts to flow in path 3 through the current mirror circuit formed with the PMOS transistors 412 and 432 and the electric potential at the node VC2 is raised. When the electric potential at the node VC2 becomes higher than or equal to the electric potential at the node VB2, the output signal from the comparator 451 goes high, turning on the switch 450. Thus, the node VB2 and node VC2 are connected together and have the same electric potential.

When the switch 450 is turned on, a state in which the bypass capacitor 440 is connected between the gate and source of the NMOS transistor 411 is established, so the gate-source voltage VGS applied to the NMOS transistor 421 may be maintained at a fixed level.

As a result, even if the power supply voltage VDD varies, the current flowing in path 1 including the NMOS transistor 411 and the current flowing in path 2 including the NMOS transistor 421 can be stabilized, so a high PSRR may be achieved.

As described above, in the bias circuit 400, the output voltage VB2 may be quickly raised by separating the node VB2 in the first current mirror circuit formed with the NMOS transistors 411 and 421, which are respectively included in path 1 and path 2, from the bypass capacitor 440 by the switch 450.

When the electric potential at the node VC2 with the bypass capacitor 440 becomes higher than the electric potential at the node VB2, the switch 450 is turned on and the node VB2 and node VC2 are thereby connected together. After the output voltage VB2 has been raised, therefore, a high PSRR may be achieved.

In this embodiment, therefore, the bias circuit 400 that achieves both a high PSRR and quick start-up operation may be provided.

Figure 9:
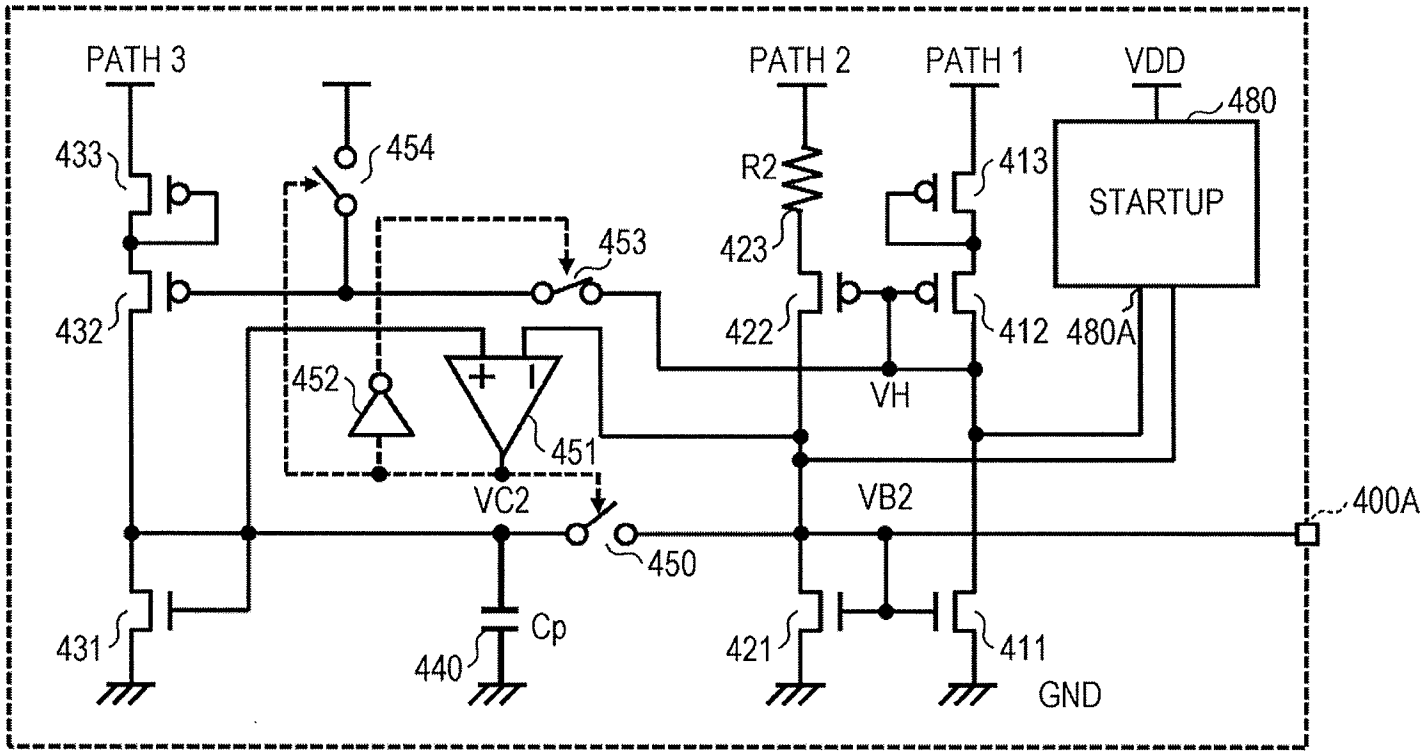
FIG. 9 illustrates still another bias circuit.

In this embodiment, an inverter 452 and switches 453 and 454 may added as in a bias circuit 401 illustrated in FIG. 9, which is a variation of this embodiment. This circuit is equivalent to a circuit obtained by adding the inverter 452 and switches 453 and 454 to the bias circuit 400 in FIG. 8.

The input terminal of the inverter 452 is connected to the output terminal of the comparator 451, and the output terminal of the inverter 452 is connected to the control terminal of the switch 453.

One end (left terminal in FIG. 9) of the switch 453 is connected to the gate of the PMOS transistor 432 and the other end (lower terminals in FIG. 9) of the switch 454. The other end (right terminal in FIG. 9) of the switch 453 is connected to the node VH. The control terminal of the switch 453 is connected to the output terminal of the inverter 452. The switch 453 is an example of the second switch.

One end (upper terminal in FIG. 9) of the switch 454 is connected to the power supply VDD. The control terminal of the switch 454 is controlled by the output terminal of the comparator 451. The switch 454 is an example of the third switch.

The node connected to the gate of the PMOS transistor 432 will be referred to as the node VP.

When the output from the comparator 451 is low at, for example, the activation of the bias circuit 401, the switch 450 is turned off, the switch 453 is turned on, and the switch 454 is turned off. That is, while the electric potential at the node VB2 is higher than the electric potential at the node VC2 (the output from the comparator 451 is L level), the bias circuit 401 operates just like the bias circuit 400 illustrated in FIG. 8.

When the electric potential at the node VC2 is raised to or above the electric potential at the node VB2, the switch 450 is turned on, the switch 453 is turned off, and the switch 454 is turned on. Since the node VB2 and node VC2 are then connected together, the bypass capacitor 440 may be added to maintain the gate-source voltage VGS applied to the NMOS transistor 421 at a fixed level.

As a result, it becomes possible to stabilize currents flowing in path 1 including the NMOS transistor 411 and path 2 including the NMOS transistor 421, so a high PSRR may be achieved.

In this case, the PMOS transistor 432 is turned off, so no current flows in path 3.

With bias circuit 401 in the variation of this embodiment, both a high PSRR and quick start-up operation may be achieved and power consumption may be reduced.

Figure 10:
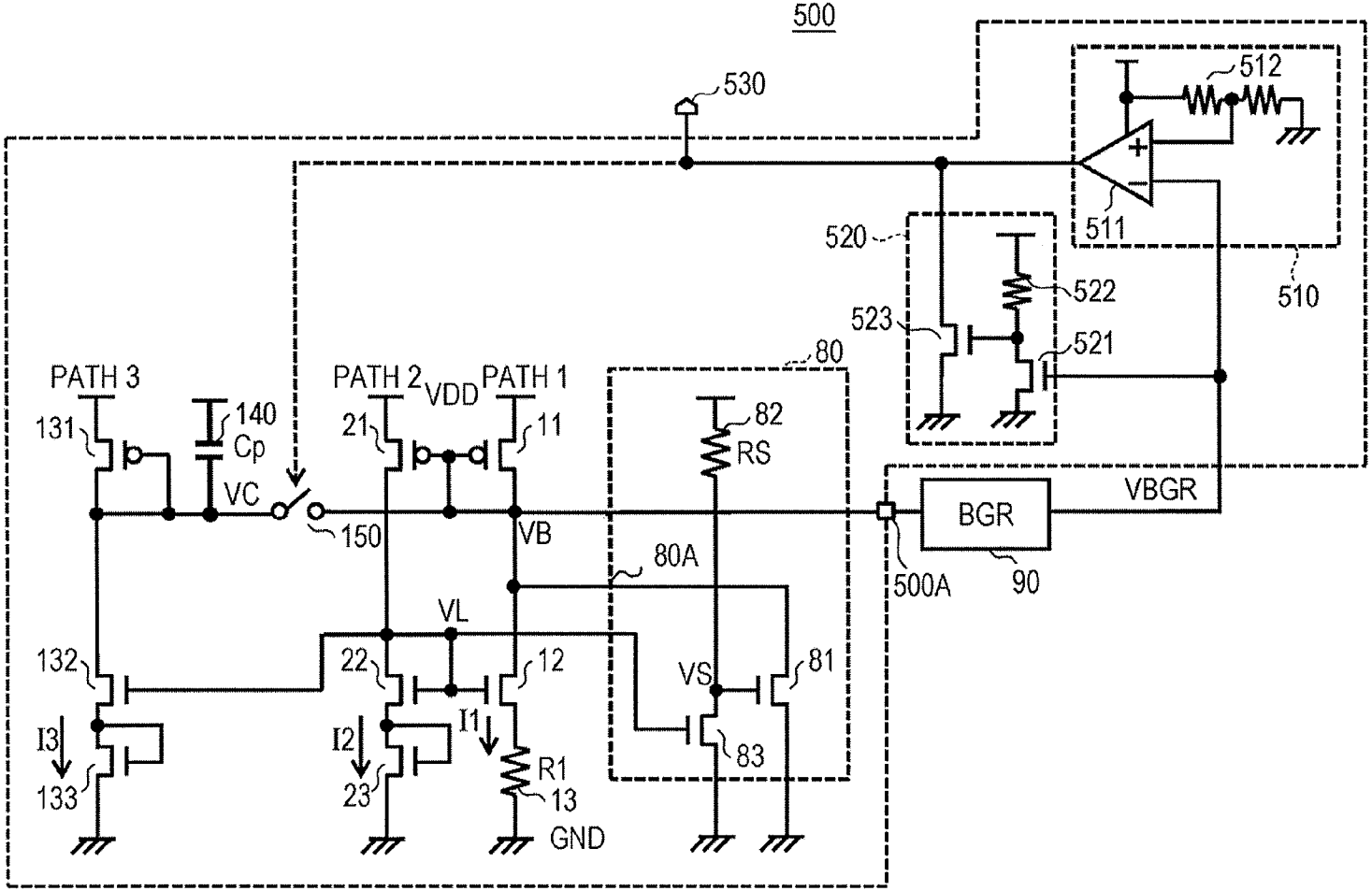
FIG. 10 illustrates still another bias circuit.

FIG. 10 illustrates a bias circuit 500.

The bias circuit 500 differs from the bias circuit 100 in that the comparator 151 is removed from the bias circuit 100 and a comparison circuit 510 and a control circuit 520 are added instead. Since other structures are the same as in the bias circuit 100, like elements are assigned like reference numerals, and their descriptions will be omitted. In FIG. 10, the BGR circuit 90 is indicated besides the bias circuit 500.

A power supply circuit or system that incorporates any one of the bias circuits 100 to 401 often includes a circuit that generates a power-on reset (POR) signal. This circuit includes a comparator. The POR signal is used, for example, to reset a microcomputer or the like included in the power supply circuit or system or to turn power off.

The bias circuit 500 uses a POR signal to selectively turn on and off the switch 150. The switch 150 is selectively turned on and off as in the embodiment illustrated in FIG. 4. That is, immediately after the bias circuit 500 has been activated, the switch 150 is turned off to achieve quick start-up operation. After the output voltage VB has been raised and the output voltage VBGR has been activated and the power supply voltage VDD is higher, the switch 150 is turned on to obtain a high PSRR.

The comparison circuit 510 includes a comparator 511 and a voltage dividing circuit 512.

The comparator 511, included in a circuit that generates a POR signal, is shared as a circuit that generates a POR signal and a comparator used in the bias circuit 500.

The inverting input terminal of the comparator 511 is connected to the output terminal of the BGR circuit 90, and the non-inverting input terminal is connected to the output terminal of the voltage dividing circuit 512 (intermediate point between two resistors connected in series). The output terminal of the comparator 511 is connected to a POR signal output terminal 530 and the control terminal of the switch 150.

The voltage dividing circuit 512, which includes two resistors connected in series, divides the power supply voltage VDD supplied from the power supply VDD. An intermediate point between the two resistors in the voltage dividing circuit 512 is connected to the non-inverting input terminal of the comparator 511 is connected.

The control circuit 520 includes an NMOS transistor 521, a resistor 522, and an NMOS transistor 523.

The gate of the NMOS transistor 521 is connected to the output terminal of the BGR circuit 90. The drain of the NMOS transistor 521 is connected to the other end (lower terminal in FIG. 10) of the resistor 522 and the gate of the NMOS transistor 523. The source of the NMOS transistor 521 is grounded.

One end (upper terminal in FIG. 10) of the resistor 522 is connected to the power supply VDD.

The drain of the NMOS transistor 523 is connected to the POR signal output terminal 530 and the control terminal of the switch 150. The source of the NMOS transistor 523 is grounded.

When the bias circuit 500 of this type is activated, the power supply voltage VDD starts to be gradually raised and the output voltage VB starts to be gradually raised from the low level. Thus, the output voltage VBGR of the BGR circuit 90 is also gradually raised.

While the output voltage VBGR of the BGR circuit 90 is low and the NMOS transistor 521 is turned off, the power supply voltage VDD is supplied through the resistor 522 to the gate of the NMOS transistor 523, turning on the NMOS transistor 523. Therefore, the signal level of the POR signal output terminal 530 is low independently of the output from the comparator 511.

Thus, immediately after the bias circuit 500 has been activated, the switch 150 is turned off. Accordingly, the output voltage VB may be quickly raised by separating the node VB in the first current mirror circuit formed with the PMOS transistors 11 and 21, which are respectively included in path 1 and path 2, from the bypass capacitor 140 by the switch 150.

When the output voltage VBGR in the BGR circuit 90 is raised and the power supply voltage VDD is also raised (see FIGS. 5A and 5B), if a divided voltage of the power supply voltage VDD, which is supplied from the voltage dividing circuit 512 to the non-inverting input terminal, becomes higher than the output voltage VBGR, which is output from the BGR circuit 90 to the inverting input terminal of the comparator 511, the output from the comparator 511 goes high (H level).

When the output voltage VBGR from the BGR circuit 90 is raised, the NMOS transistor 521 is turned on. Thus, the NMOS transistor 523 is turned off because its gate voltage goes low. At the POR signal output terminal 530, the output from the comparator 511 appears as is, without constraints by the control circuit 520.

As a result, the switch 150 is turned on. The state in which the switch 150 is turned on is such that the output voltage in the bias circuit 500 had been raised to the output voltage VB and the output voltage VBGR from the BGR circuit 90 has been stabilized.

In the bias circuit 500, therefore, when the output voltage VB has been raised, the switch 150 is turned on, then connecting the node VB and node VC. After the output voltage VB has been raised, therefore, a high PSRR can be achieved.

In this embodiment, therefore, the bias circuit 500 that achieves both a high PSRR and quick start-up operation can be provided.

This completes the descriptions of the bias circuits in exemplary embodiments of the present disclosure. However, the present disclosure is not limited to the embodiments that have been specifically disclosed; many variations and changes are possible without departing from the scope of the claims.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A bias circuit, comprising:

a reference current generation circuit that has a first reference current element disposed in a first current path and has a second reference current element disposed in a second current path, the first current path and the second current path being disposed between a power supply terminal and a reference electric potential terminal;

a first current mirror circuit that has a first transistor connected in series with the first reference current element in the first current path and has a second transistor connected in series with the second reference current element in the second current path, the first current mirror circuit being configured to output a prescribed bias voltage from a first node connected to a control terminal of the first transistor and to a control terminal of the second transistor;

a third reference current element disposed in a third current path disposed between the power supply terminal and the reference current element;

a third transistor connected in series with the third reference current element in the third current path, the third transistor being configured to form a second current mirror circuit together with the first transistor or the second transistor;

a bypass capacitor connected between the power supply terminal and a second node connected to a control terminal of the third transistor;

an activation circuit connected to the first node, the activation circuit being configured to control an electric potential at the first node and activate the first transistor; and a first switch connected between the first node and the second node, the first switch being turned on when the electric potential at the first node is raised.

2. The bias circuit according to claim 1, further comprising a comparator that has one input terminal connected to the first node, another input terminal connected to the second node, and an output terminal connected to a control terminal of the first switch, the comparator being configured to output, from the output terminal, a signal that turns on the first switch when an input voltage at the one input terminal is higher than an input voltage at the another input terminal.

3. The bias circuit according to claim 1, further comprising:

a second switch connected between a control terminal of the reference current generation circuit and a control terminal of the third reference current element, the second switch being turned off when the first switch is turned on; and a third switch connected between the reference electric potential terminal and the control terminal of the third reference current element, the third switch being turned on when the first switch is turned on.

4. The bias circuit according to claim 3, further comprising an inverter that inverts a control signal that turns on the first switch, and outputs a control signal that turns off the second switch.

5. A bias circuit, comprising:

a reference current generation circuit that has a first reference current element disposed in a first current path and also has a second reference current element disposed in a second current path, the first current path and the second current path being disposed between a power supply terminal and a reference electric potential terminal;

a first current mirror circuit that has a first transistor connected in series with the first reference current element in the first current path and also has a second transistor connected in series with the second reference current element in the second current path, the first current mirror circuit being configured to output a prescribed bias voltage from a first node connected to a control terminal of the first transistor and to a control terminal of the second transistor;

a third reference current element disposed in a third current path disposed between the power supply terminal and the reference current element;

a third transistor connected in series with the third reference current element in the third current path, the third transistor being configured to form a second current mirror circuit together with the first transistor or the second transistor;

a bypass capacitor connected between the reference electric potential terminal and a second node connected to a control terminal of the third transistor;

an activation circuit connected to a control terminal of the reference current generation circuit, the activation circuit being configured to control an electric potential at the control terminal of the reference current generation circuit and activate the reference current generation circuit; and a first switch connected between the first node and the second node, the first switch being turned on when the electric potential at the second node is raised.

6. The bias circuit according to claim 5, further comprising a comparator that has one input terminal connected to the first node, another input terminal connected to the second node, and an output terminal connected to a control terminal of the first switch, the comparator being configured to output, from the output terminal, a signal that turns on the first switch when an input voltage at the another input terminal is higher than an input voltage at the one input terminal.

7. The bias circuit according to claim 5, further comprising:

a second switch connected between a control terminal of the reference current generation circuit and a control terminal of the third reference current element, the second switch being turned off when the first switch is turned on; and a third switch connected between the power supply terminal and the control terminal of the third reference current element, the third switch being turned on when the first switch is turned on.

8. The bias circuit according to claim 7, further comprising an inverter that inverts a control signal that turns on the first switch, and also outputs a control signal that turns off the second switch.

* * * * *